US011067369B2

(12) United States Patent
Goodman

(10) Patent No.: US 11,067,369 B2
(45) Date of Patent: Jul. 20, 2021

(54) RF ATTENUATING SWITCH FOR USE WITH EXPLOSIVES AND METHOD OF USING THE SAME

(71) Applicant: Schlumberger Technology Corporation, Sugar Land, TX (US)

(72) Inventor: Kenneth Randall Goodman, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 847 days.

(21) Appl. No.: 15/195,757

(22) Filed: Jun. 28, 2016

(65) Prior Publication Data

US 2017/0176152 A1 Jun. 22, 2017

Related U.S. Application Data

(60) Provisional application No. 62/269,367, filed on Dec. 18, 2015.

(51) Int. Cl.

| | |
|---|---|
| ***F42B 3/18*** | (2006.01) |
| ***E21B 43/1185*** | (2006.01) |
| ***F42B 3/14*** | (2006.01) |
| ***F42B 3/188*** | (2006.01) |

(Continued)

(52) U.S. Cl.

CPC ..... *F42B 3/18* (2013.01); *E21B 43/1185* (2013.01); *F42B 3/182* (2013.01); *F42B 3/188* (2013.01)

(58) Field of Classification Search

CPC .... E21B 43/11; E21B 43/116; E21B 43/1185; E21B 43/11857; E21B 43/263; F42B 3/103; F42B 3/14; F42B 3/18; F42B 3/182; F42B 3/188; F42B 3/195; F42B 3/10; F42B 3/124; F42C 15/40; F42C 19/12; F42C 11/00; F42D 1/00; F42D 1/02; F42D 1/04; F42D 1/043; F42D 1/045; F42D 1/05; F42D 1/055; F42D 1/22; F42D 3/00; F42D 3/04; H05K 7/005; H05K 1/0271; B63C 9/24;

(Continued)

(56) References Cited

U.S. PATENT DOCUMENTS 4,261,263 A * 4/1981 Coultas ..... F42B 3/18 102/202.7
4,378,738 A * 4/1983 Proctor ..... F42B 3/188 102/202.12

(Continued)

FOREIGN PATENT DOCUMENTS

GB 2352261 A * 1/2001 ..... E21B 43/11857
WO WO-2013173404 A1 * 11/2013

OTHER PUBLICATIONS (JRC Jet Research Center • Pioneer of the Oilwell Shaped Charge [online], jetresearch.com [retrieved on [Aug. 2008], Retrieved from the Internet: <URL: https://www.jetresearch.com/content/dam/jrc/Documents/Brochures/jrc0011.pdf> (Year: 2008).*

*Primary Examiner* — Jared Fureman
*Assistant Examiner* — Nicolas Bellido
(74) *Attorney, Agent, or Firm* — Cameron R. Sneddon

(57) ABSTRACT

A radio frequency attenuating switch including a switch having a first input for connection to an electrical power supply and first and second output leads for connecting a device such as a detonator. One or more RF mitigation devices are connected within one or more of the output leads.

11 Claims, 5 Drawing Sheets

(51) Int. Cl.
*F42D 1/045* (2006.01)
*H05K 7/00* (2006.01)
*F42B 3/182* (2006.01)

(58) Field of Classification Search
CPC ..... F02C 7/266; F02P 15/003; F02P 3/0552; F02P 3/0838; F02P 7/03; F02P 9/007; F23N 1/02; F23N 2027/28; F23N 2027/36; F23N 5/123; F23Q 3/00; F23Q 3/004; F23Q 3/006; F23Q 7/00; F23Q 7/02; F23Q 9/04; F24C 3/103; F41A 19/65; G01N 21/67; G03B 15/0457; H01T 13/50; H02K 39/00; H03K 17/0822; H04W 72/0406; H04W 72/082
USPC ..... 102/200, 202.8, 202.9, 206; 361/248, 361/249, 250, 251, 252, 253, 255, 257; 455/63.1, 67.13, 442, 450, 452.2, 501
See application file for complete search history.

(56) References Cited

U.S. PATENT DOCUMENTS 5,503,077 A * 4/1996 Motley ..... F42B 3/13 102/202.1
7,116,542 B2 10/2006 Lerche et al.
7,347,278 B2 * 3/2008 Lerche ..... E21B 41/00 102/215
7,975,612 B2 * 7/2011 Teowee ..... F42D 1/05 102/206
8,091,477 B2 * 1/2012 Brooks ..... F42B 3/121 102/202.7
8,230,946 B2 * 7/2012 Crawford ..... F42D 5/04 175/4
8,365,825 B1 * 2/2013 Yarbro ..... E21B 43/11857 102/312
8,601,948 B2 * 12/2013 Spring ..... F42B 3/14 102/202.2
9,064,650 B2 * 6/2015 Keppler ..... E21B 43/1185
2004/0108114 A1 * 6/2004 Lerche ..... E21B 17/003 166/302
2005/0178282 A1 * 8/2005 Brooks ..... F42B 3/121 102/202.7
2006/0249045 A1 * 11/2006 Goodman ..... F42D 1/045 102/305
2012/0247769 A1 * 10/2012 Schacherer ..... E21B 29/02 166/297
2014/0131035 A1 * 5/2014 Entchev ..... E21B 43/263 166/255.1
2015/0096752 A1 * 4/2015 Burgos ..... E21B 43/1185 166/297

* cited by examiner

RF ATTENUATING SWITCH FOR USE WITH EXPLOSIVES AND METHOD OF USING THE SAME

CROSS-REFERENCES TO RELATED APPLICATIONS

This application claims the benefit under 35 U.S.C. § 119(e) of U.S. Provisional Patent Application No. 62/269,367, filed Dec. 18, 2015, which is incorporated herein by reference in its entirety as if fully set forth herein.

BACKGROUND

This section provides background information to facilitate a better understanding of the various aspects of the disclosure. It should be understood that the statements in this section of this document are to be read in this light, and not as admissions of prior art.

Explosives are used in many types of applications, such as hydrocarbon well applications, seismic applications, military armament, and mining applications. In seismic applications, explosives are discharged at the earth surface to create shock waves into the earth subsurface so that data regarding the characteristics of the subsurface may be measured by various sensors. In the hydrocarbon well context, a common type of explosive that is used includes shaped charges in perforating guns. The shaped charges, when detonated, create perforating jets to extend perforations through any surrounding casing or liner and into the surrounding formation to allow communication of fluids between the formation and the wellbore. Also, in a well, other tools may also contain explosives. For example, pyrotechnics can be used to set packers or to activate other tools.

SUMMARY

A radio frequency (RF) attenuating switch includes a RF mitigation device connected in an input lead, a printed circuit board, and/or an output lead of a switch. In some embodiments at least two RF mitigation devices are included within the switch to provide redundant safety protection. An explosive assembly in accordance to one or more aspects of the disclosure includes a switch having first and second input leads and first and second output leads, a detonator connected to the first and second output leads, a controller connected through the first input lead to the detonator when the switch is in a closed state and a radio frequency mitigation device operationally connected between the controller and the detonator.

A method includes deploying a perforating gun into a wellbore, the perforating gun having a firing head electrically connecting an electrical power source through a first switch to a first detonator connected to a first plurality of explosive charges and electrically connecting a second switch to second detonator connected to a second plurality of explosive charges, and a radio frequency mitigation device operationally connected between the electrical power source and the first detonator, and detonating the first plurality of explosive charges in response to closing the first switch thereby connecting an electrical power supply to the first detonator.

This summary is provided to introduce a selection of concepts that are further described below in the detailed description. This summary is not intended to identify key or essential features of the claimed subject matter, nor is it intended to be used as an aid in limiting the scope of claimed subj ect matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
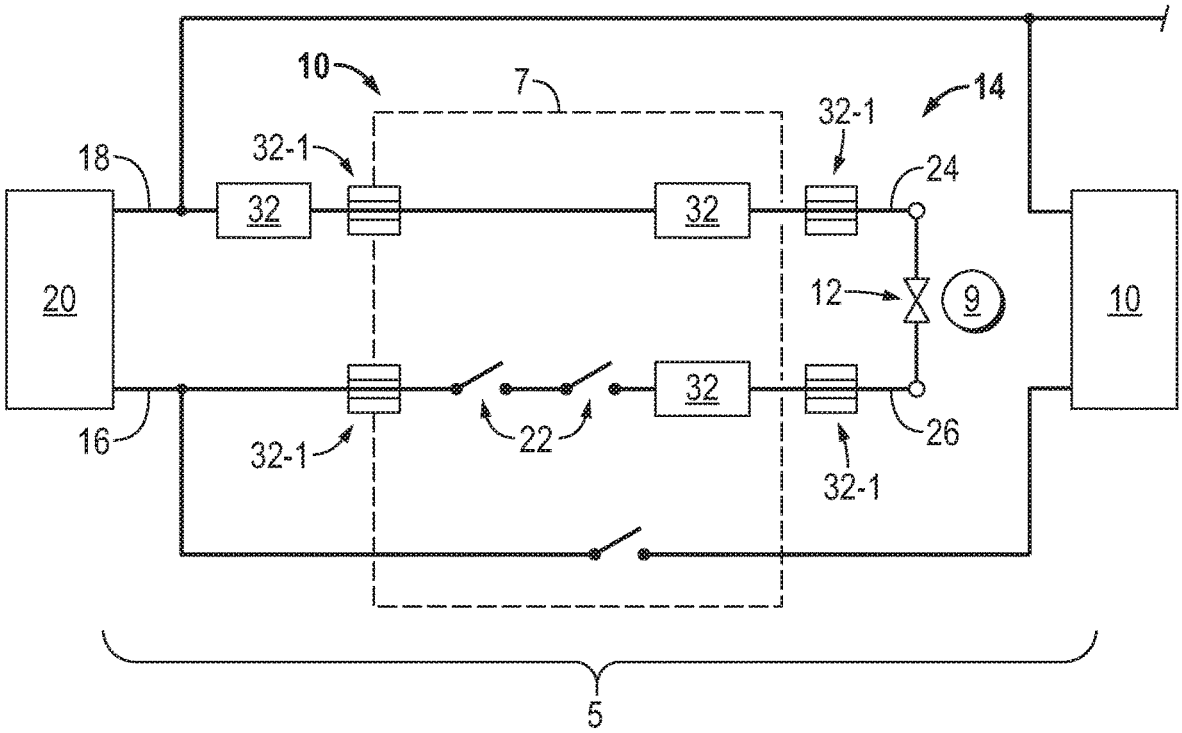
FIG. 1 is a schematic diagram of a RF attenuating switch in accordance to one or more aspects of the disclosure incorporated in an explosive assembly.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

FIGS. 1-5 are non-limiting schematic diagrams illustrating radio frequency (RF) attenuating switches 10 (i.e., switch circuits) configured for utilization in explosive assemblies generally denoted by the numeral 5. With reference to FIG. 1, the RF attenuating switch 10 is electrically connected to a detonator 12 to detonate an explosive charge 9. The RF attenuating switch 10 includes a first input lead 16 and a second input lead 18 connected to a control unit 20 in FIG. 1 which provides power and controls closure of switches 22. Control unit 20 may include one or more power sources that can be located locally and/or remote from the RF attenuating switch 10. One or more switches 22 are connected between the control unit 20 and the detonator 12. Switches 22 control the power supplied to the detonator 12 across output leads 24 and 26. In accordance to some embodiments switches 22 are field effect transistors which are generally effective as power control devices but are ineffective barriers to RF power as capacitance from drain to source effectively short the device at high RF frequencies. The switches 22 are in a default open, or safe, state. Multiple RF attenuating switches 10 may be connected as illustrated for example in FIG. 1.

The length of the leads or the effective antenna length of the switch 10 and can significantly vary depending on the operation or use case of the device. For example, in the use of a switch 10 that has not been connected with a detonator the leads may only be a few inches or less and therefore there is a limited risk of radio frequency power reception or pickup. As the effective antenna length of the switch increases the risk of unwanted power reception increases. For example, a switch 10 may have an effective antenna length of a few inches but when connected in an explosive assembly the effective antenna length of the switch circuit may increase to tens or hundreds of feet increasing the risk of unwanted power reception. The exposure to various RF frequencies and RF transmitter power is increasing as new transmission and radar towers are erected on land and offshore traffic and RF sources increase. The exposure to unwanted power sources also various based on use cases. For example, at a work site the RF power sources (e.g., radios and towers) can be identified and exposure may be limited by precautions such as increasing the distance from the sources and limiting effective antenna length. The exposure to RF sources may increase and be less controllable when transporting an explosive assembly over a roadway.

The RF attenuating switch 10 isolates the detonator 12 from the control unit 20 and it does not have a single point of failure that will allow power to the detonator. The RF attenuating switch 10 includes the wiring to the control unit and the wiring to the detonator 12. In accordance to one or more embodiments, the RF attenuating switch provides one or more methods of RF protection, e.g., greater than about 10 volt/meter, stray voltage protection for example of about 25 volts or greater, and inadvertent application of power protection, e.g., the lesser of the rating of the control power system or about 600 volts. The detonator may also be an RF-safe device that is connected to the RF attenuating switch 10 in use.

RF attenuating, or mitigation, devices generally designated by the numeral 32 (FIG. 1) are placed in the input 16, 18 and or output leads 24, 26 to provide double fault protection against shorts that occur across the switches 22 for example via RF and pinched wires. The RF mitigation devices 32 may be connected to a lead on a printed circuit board, illustrated by the box 7, and or on conductor portions (e.g., wires) external to the switch circuit board. In accordance to some embodiments, RF mitigation devices may include shielding 32-1 on the wires.

In the illustrated circuits at least two RF mitigation devices 32 are connected in a lead between the input 18 and output 24 and at least one RF mitigation device 32 is placed in the lead, i.e., circuit, between input 16 and output 26. The RF mitigation device 32 may be positioned in the input lead (signal) to the switch 10 and/or in an output lead to the detonator 12. The RF mitigation devices 32 may include various devices such as and without limitation spark gaps 36, RF chokes 40, shielding 32-1 and shunt capacitors 30. It should be recognized that a RF mitigation device may not be included in one of the leads and to provide redundancy two or more RF mitigation devices may be included in the one lead that includes RF mitigation. A single RF mitigation device may filter more than one signal.

Figure 2:
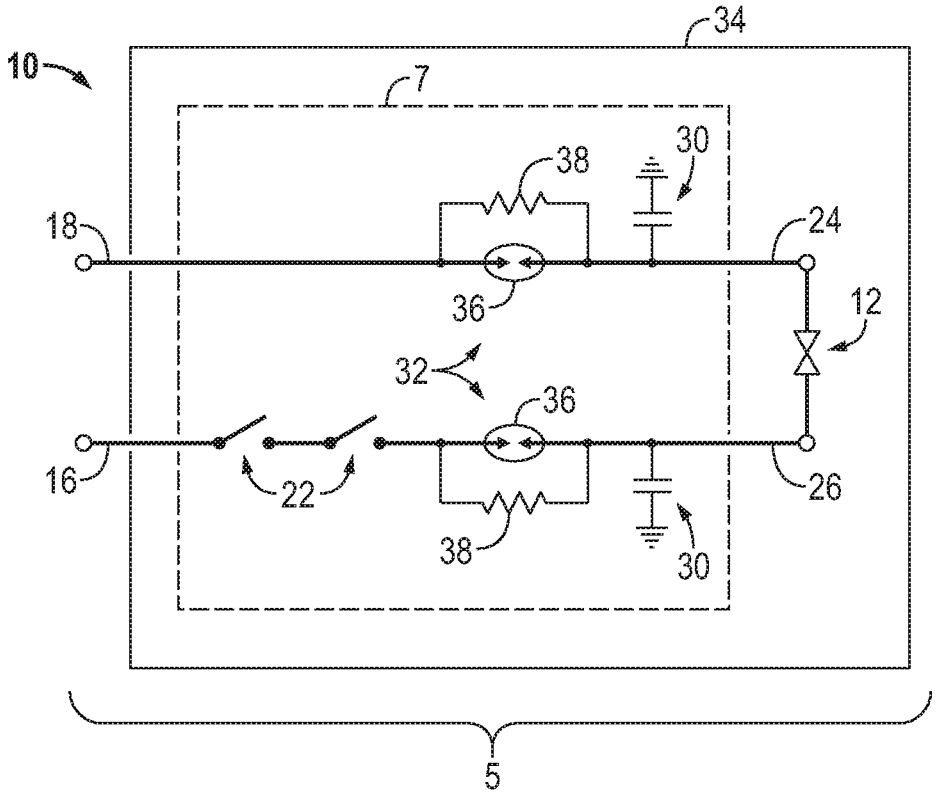
FIG. 2 is a schematic diagram of a RF attenuating switch in accordance to one or more aspects of the disclosure configured as a module with a connected detonator.
Figure 6:
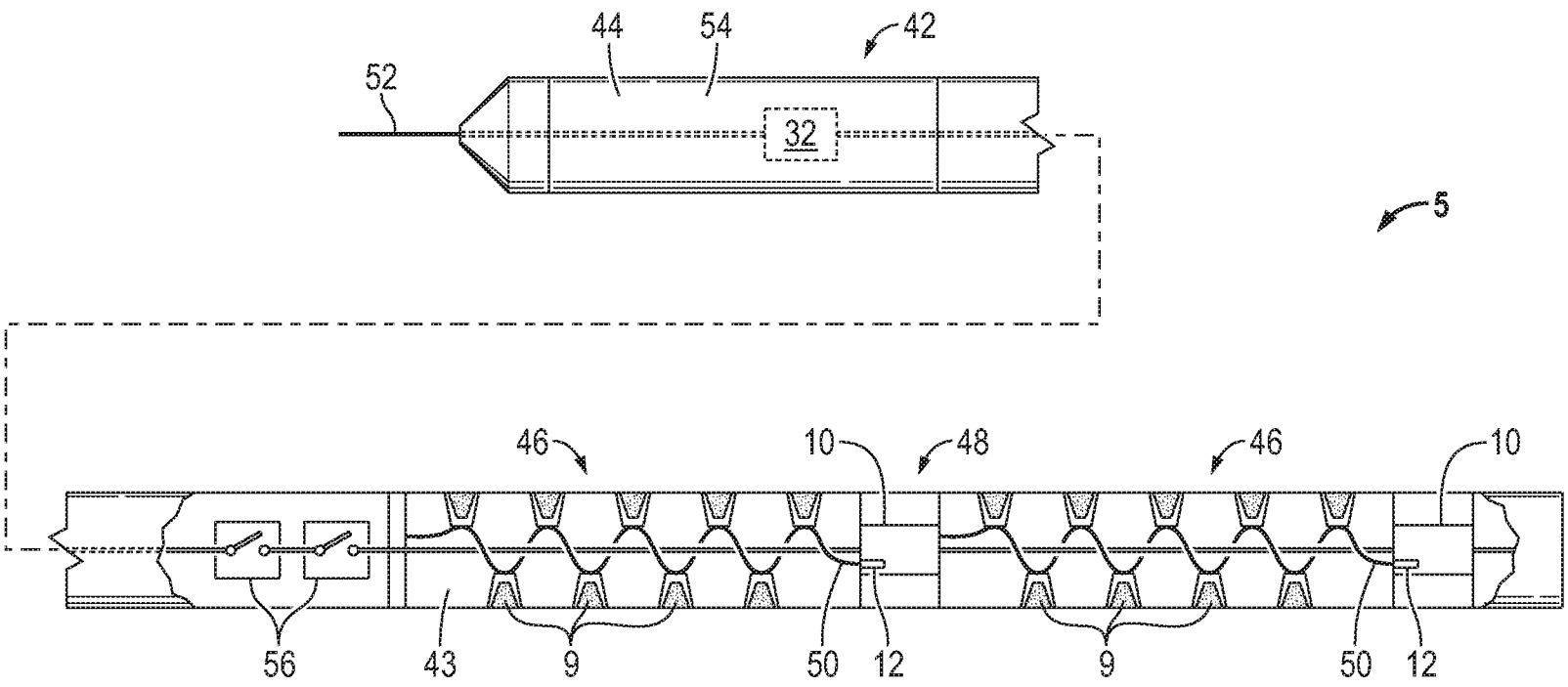
FIG. 6 illustrates a wellbore tool assembly incorporating RF attenuating switches in accordance to one or more aspects of the disclosure.

FIG. 2 is a schematic diagram illustrating a radio frequency (RF) attenuating switch 10 in accordance to one or more embodiments. In this illustrated example the RF attenuating switch 10 is configured as a module with a detonator 12, e.g., a printed circuit board and a detonator, and disposed for example in a housing 34. In the module state prior to being connected with an explosive assembly the length of the leads or the effective antenna length can be short, for example less than a foot long, and thus the risk of RF pickup is limited. However, when the module is connected in an explosive assembly for example for transport or use the effective antenna length will increase. For example, the switch in FIG. 2 may be connected within a tool, such as illustrated in FIG. 6, including connecting the control line 52 wiring to the inputs 16 and/or 18 thereby increasing the length of the leads of the switch. For example, connecting the switch into a tool may increase the effective antenna length from a few inches, e.g. four inches, to tens of feet (e.g., 10, 20, 30, 40 or more feet) thereby increasing the risk of RF power pickup. As illustrated in the various figures, the RF mitigation devices may be connected in the wiring in various locations in the tool.

In the non-limiting example of FIG. 2 the RF mitigation devices 32 are spark gaps 36 (i.e., spark gap circuits). One spark gap 36 is connected in series with the output lead 24 and the other spark gap 36 is connected in series with the output lead 26. The spark gaps 36 provide a high voltage stand-off, i.e., act as a low capacitance switch, until gas in the spark gap circuit becomes ionized and the voltage drop across the spark gap drops. The spark gap circuit raises the threshold that needs to be reached before RF exposure and/or stray voltage triggers the detonator 12. Because the spark gap circuit is an open circuit, the spark gap cannot be used to send a trickle current to test the circuit. A resistor 38 is connected in parallel with each of the spark gaps 36 to facilitate testing. In this example, the switch also includes shunt capacitors 30 to redirect the frequency noise and voltage to ground.

With reference to FIG. 2 the RF attenuating switch 10 provides RF barriers and power barriers to mitigate stray power as well as lead shorts. The RF attenuating switch 10 in FIG. 2 includes the two spark gaps 36, input leads 16 and 18 to the switch and output leads 24, 26 extending from the switch for example to the detonator 12. If input lead 18 and output lead 24, external to the switch, are shorted power protection is provided by the two switches 22 and RF protection by the spark gap in the output lead 26. If input lead 18 and output lead 26 or input lead 16 to output lead 24 are shorted then the detonator is bypassed. If input lead 16 to output lead 26 is shorted then protection is provided at the spark gap 36 in the output lead 24.

Figure 3:
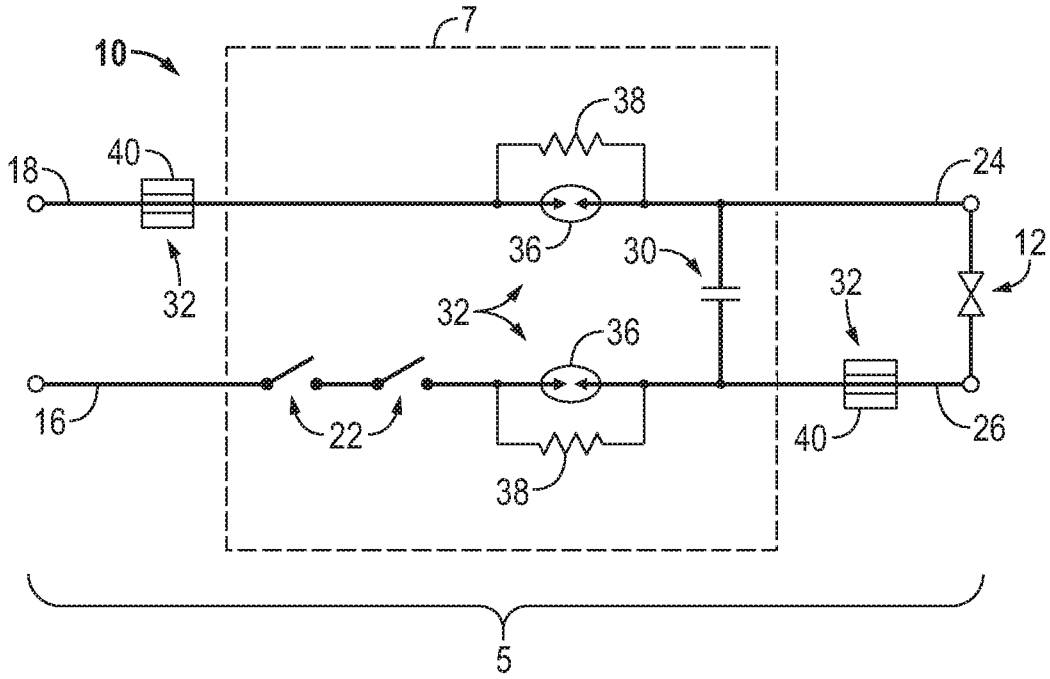
FIGS. 3 to 5 are schematic diagrams illustrating additional non-limiting examples of RF attenuating switches in accordance to one or more aspects of the disclosure incorporated in an explosive assembly.

FIG. 3 illustrates a non-limiting example of a RF attenuating switch 10 connected in an explosive assembly 5. In this example, spark gaps 36 connected in series with each of the output leads 24, 26 for example on the circuit board 7. A RF mitigation device 32 in the form of a RF choke 40 is connected in one of the input leads, e.g. input 18, and another RF mitigation 32 in the form of a RF choke 40 is located in one of the output leads, e.g. output 26. In this example the RF chokes 40 are located in the wiring external to the printed circuit board. RF attenuation may be improved by utilizing RF chokes 40 on an input and an output lead or leads as opposed to one RF choke on the input or the output. With reference to FIG. 6 an RF mitigation device 32 is shown connected to the wiring in the firing head 44. RF mitigation devices 32 may be included in other locations, such as sub or tool (e.g., casing collar locator), remote from the switch.

Figure 4:
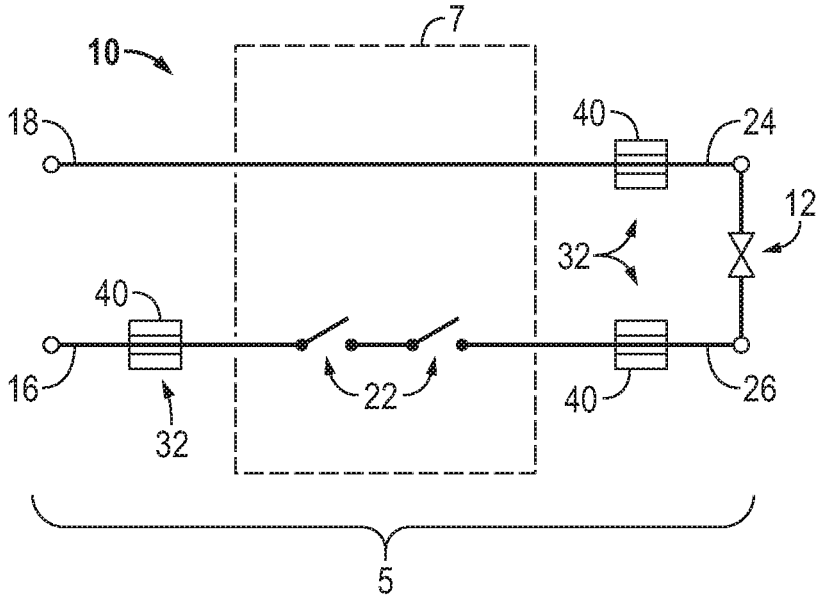
Figure 5:
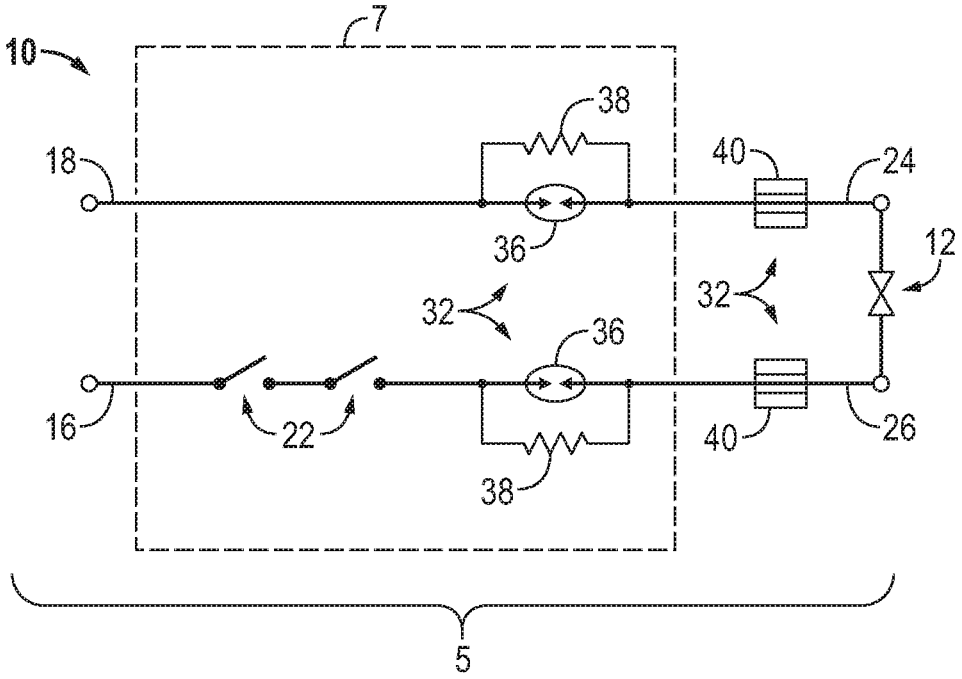

In FIG. 4 the illustrated RF attenuating switch 10 is illustrated utilizing RF mitigation devices 32 in the form of RF chokes 40, for example ferrite beads or other inductors. The RF chokes may be incorporated as inductors placed for example on the wire leads or pins of switch 10 circuit. The RF chokes have an impedance to block the stray high frequency signals. In FIG. 5 the RF attenuating switch 10 utilizes both spark gap 36 circuits and RF chokes 40 as the RF mitigation devices 32.

FIG. 6 illustrates an explosive assembly 5 configured in a wellbore device or tool 42, e.g. a perforating gun, and utilizing RF attenuating switches 10 connected to detonators 12 in accordance to one or more embodiments of the disclosure. The RF attenuating switch 10 is disposed in and operationally connected with a carrier 43 (e.g. loading tube and/or housing). Connecting the RF attenuating switch 10 in the carrier 43 may include connecting the input leads to wiring in the carrier thereby increasing the effective antenna length of the RF attenuating switch 10 for example from a few inches or a few feet to tens of feet or more. The carrier 43 with the RF attenuating switch and detonator 12 may be transported over the roadway. In some instances carrier 42 may be transported over the roadways with the RF attenuating switch 10, detonators 12, and explosive charges 9 installed.

The illustrated wellbore tool 42 is arranged as a perforating gun having a firing head 44 connected to individually controlled gun sections 46 each comprising a plurality of shaped explosive charges 9. The gun sections 46, e.g., explosive devices, can be individually controlled by the associated RF attenuating switches 10, see for example FIGS. 1-5.

In accordance to embodiments, the explosive assembly 5 is a selectable firing system 48. A series of RF attenuating switches 10 (addressable or non-addressable switches) are connected to detonators 12. Each RF attenuating switch 10 and detonator 12 are connected via a detonation cord 50 to associated explosive charges 9 of a gun section 46. For example in FIGS. 6 and 7 the top gun section 46 is connected to the RF attenuating switch 10 that is positioned between the two gun sections and the bottom gun section 46 is connected to the bottom RF attenuating switch 10, wherein the firing head is the top of the wellbore tool.

Digital communications can be used to operationally test, arm and fire the RF attenuating switches 10. The switch may be tested when the tool is assembled and prepared for transport, at a well site, and or when connected to a control line and suspended for example in the wellbore. Each RF attenuating switch 10 may or may not have a unique address to individually identify the associated explosive device (e.g., gun section). All circuits, gun wiring, and connections can be tested at the surface prior to running into the wellbore. While running in hole, the testing can be done with a perforation acquisition system.

Electrical power and control signals may be communicated from the surface of a wellbore to the gun assembly via a control line 52 (e.g., wireline) which includes or is an extension of the inputs 16, 18 (FIGS. 1-5). The firing head may include one or more operational devices 54 such as and without limitation telemetry systems and sensor systems such as accelerometers, inclinometers, magnetometers, pressure, temperature and depth correlation sensors. In accordance to one or more embodiments, the firing head 44 is operationally connected to the explosive charges 9 of the tool sections 46 through an arming switch 56 which may be a part of the firing head.

Figure 7:
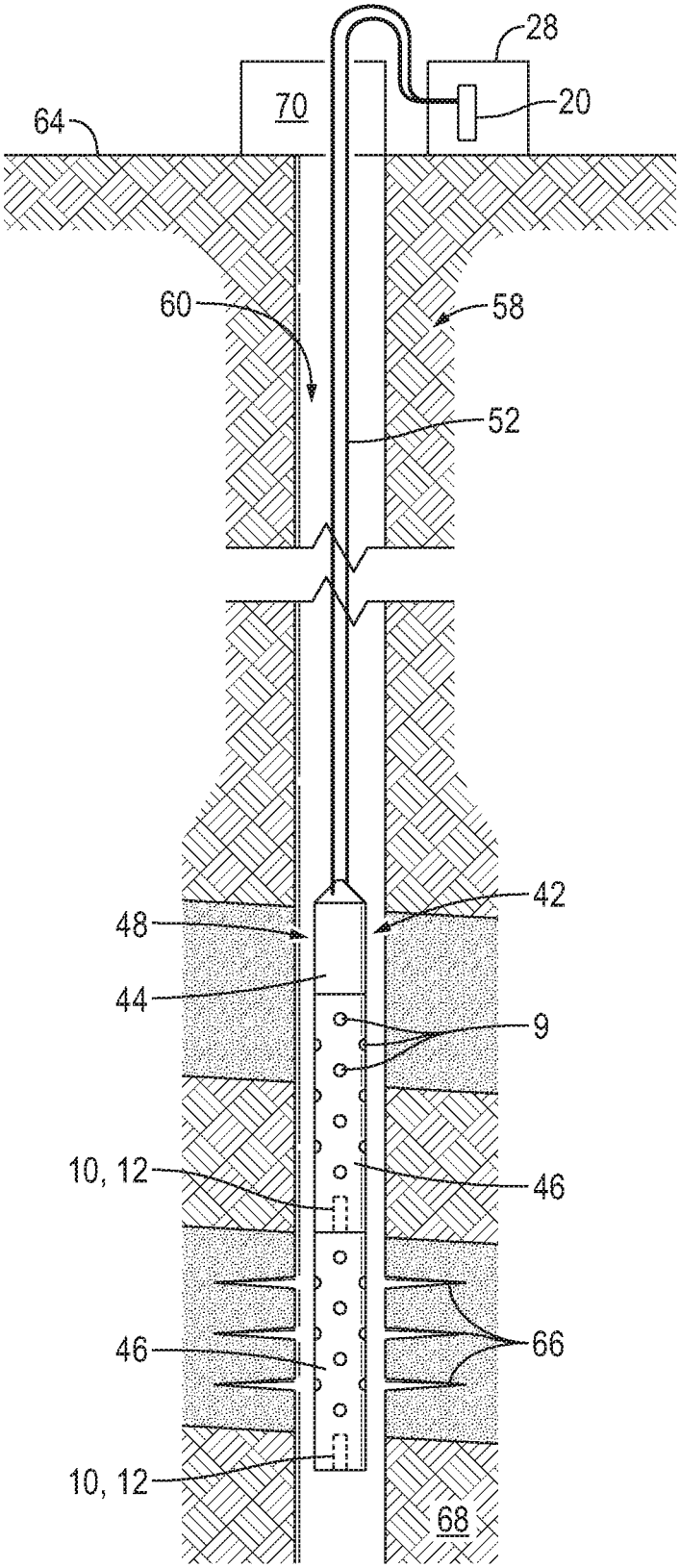
FIG. 7 illustrates a wellbore in which an explosive assembly is deployed and incorporates a RF attenuating switch in accordance to one or more aspects of the disclosure is deployed.

FIG. 7 illustrates a wellbore tool 42 utilizing a RF attenuating switch 10 deployed in a well system 58. The wellbore tool 42 is deployed in a wellbore 60 on a conveyance, which is a wireline 52, i.e. control line, in the illustrated example. The control line 52 connects the control unit 20 and in the illustrated example a processor 28 located at the surface 64 to input leads of the RF attenuating switch 10 disposed in the wellbore tool 42. When the wellbore tool 42 is connected with the control line and suspended from the surface rig 70 the effective antenna length of the switch may be in the hundreds of feet increasing the RF pickup of the systems as compared to the switch alone.

The wellbore tool 42 may incorporate a firing system 48 utilizing RF attenuating switches 10. The RF attenuating switches 10 have no single faults. In accordance to one or more embodiments, the RF attenuating switches 10 provide one or more methods of RF protection, e.g., greater than about 10 volt/meters, stray voltage protection for example of about 25 volts or greater, and inadvertent application of power protection, e.g., the lesser of the rating of the control power system or about 600 volts. In accordance to some embodiments, electrostatic discharge for example of about 15 kV or greater are provided. In accordance to some embodiments RF protection of about 10 volt/meters or greater is provided.

Once located in the desired location in the wellbore the individual gun sections 46 may be activated via the associated RF attenuating switch 10 to detonate the associated explosive charges 9 and create perforations 66 in the surrounding formation 68. The activating comprises operating the respective RF attenuating switches 10 to a closed position to connect the electrical control unit 20 to the detonator 12 thereby detonating the detonator 12 and the connected explosive charges 9. In accordance to embodiments, activating includes communicating a command via telemetry to close the RF attenuating switch.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method, comprising:

deploying a perforating gun into a wellbore, the perforating gun comprising a firing head electrically connecting an electrical power source through a first RF attenuating switch to a first detonator connected to a first plurality of explosive charges and electrically connecting a second RF attenuating switch to a second detonator connected to a second plurality of explosive charges, wherein each RF attenuating switch comprises:

a first input lead connected to the electrical power source;

a second input lead connected to the electrical power source;

a first output lead connected to the detonator;

a second output lead connected to the detonator; and a first RF mitigation device connected to a first output lead of the RF attenuating switch;

a second RF mitigation device connected to a second output lead of the RF attenuating switch, wherein the first and second RF mitigation device comprises a spark gap connected in series with the first and second output leads;

a first and second resistor connected in parallel with each of the spark gaps; and detonating the first plurality of explosive charges in response to closing the first RF attenuating switch thereby connecting an electrical power supply to the first detonator.

2. The method of claim 1, wherein the RF mitigation device is connected to a printed circuit board (PCB) of the first RF attenuating switch.

3. The method of claim 1, wherein one or more RF mitigation devices in addition to the first and second RF mitigation devices are connected to or surrounding at least one of the input leads or one of the output leads, the one or more RF mitigation devices comprising one or more of a spark gap, a capacitor, a RF choke or shielding.

4. The method of claim 1, wherein the RF mitigation device comprises a first RF mitigation device connected to or surrounding the first output lead from the RF attenuating switch and a second RF mitigation device connected to or surrounding the second output lead of the RF attenuating switch.

5. The method of claim 1, wherein the RF mitigation device is connected to or surrounding a first output lead of the RF attenuating switch; and, wherein the perforating gun further comprises:

a second RF mitigation device connected to or surrounding a second output lead of the RF attenuating switch; and a third RF mitigation device connected to or surrounding an input lead to the RF attenuating switch.

6. The method of claim 5, wherein the RF attenuating switch further comprises: at least one switch connected to the second output lead.

7. The method of claim 1, wherein the RF mitigation device surrounds the first input lead to the RF attenuating switch; and, wherein the perforating gun further comprises:

a second RF mitigation device surrounding a first output lead of the RF attenuating switch; and a third RF mitigation device surrounding a second output lead of the RF attenuating switch.

8. The method of claim 7, wherein the RF attenuating switch further comprises: at least one switch connected to the second output lead.

9. The method of claim 1, wherein the RF mitigation device is connected to a first output lead of the RF attenuating switch; and, wherein the perforating gun further comprises:

a second RF mitigation device connected to a second output lead of the RF attenuating switch, wherein the first and second RF mitigation device comprises a spark gap connected in series with the first and second output leads;

a third RF mitigation device surrounding the first output lead of the RF attenuating switch; and a fourth RF mitigation device surrounding the second output lead of the RF attenuating switch.

10. The method of claim 1, wherein the perforating gun further comprises:

a third RF mitigation device surrounding the first input lead of the RF attenuating switch; and a fourth RF mitigation device surrounding the second output lead of the RF attenuating switch.

11. The method of claim 1, wherein the RF attenuating switch further comprises:

a shunt capacitor connected to at least one of the first or second output lead.

* * * * *